US008574026B2

(12) United States Patent
Livingstone

(10) Patent No.: US 8,574,026 B2
(45) Date of Patent: Nov. 5, 2013

(54) CLOTHING ARTICLE INCLUDING A BUILT-IN BRA

(75) Inventor: Elizabeth L. Livingstone, Holmdel, NJ (US)

(73) Assignee: Ballet Makers, Inc., Totowa, NJ (US)

( * ) Notice: Subject to any disclaimer, the term of this patent is extended or adjusted under 35 U.S.C. 154(b) by 346 days.

(21) Appl. No.: 13/012,236

(22) Filed: Jan. 24, 2011

(65) Prior Publication Data

US 2012/0190271 A1 Jul. 26, 2012

(51) Int. Cl.
*A41C 3/00* (2006.01)

(52) U.S. Cl.
USPC ..... 450/30; 450/33

(58) Field of Classification Search
USPC ..... 450/30–33, 17–19; 2/69, 67, 105, 106
See application file for complete search history.

(56) References Cited

U.S. PATENT DOCUMENTS

| | | | | |
|---|---|---|---|---|
| 2,863,460 | A | 12/1958 | Monroe | |
| 4,378,805 | A | 4/1983 | Reichert et al. | |
| 5,119,511 | A * | 6/1992 | Packer et al. | 2/67 |
| 5,478,278 | A * | 12/1995 | Greenblatt | 450/32 |
| 5,678,246 | A * | 10/1997 | Cooley et al. | 2/67 |
| 6,811,462 | B1 * | 11/2004 | Kenneally | 450/30 |

* cited by examiner

*Primary Examiner* — Gloria Hale
(74) *Attorney, Agent, or Firm* — Laubscher & Laubscher, P.C.

(57) ABSTRACT

A clothing article such as a leotard has a built-in bra that is connected with the article only along an upper edge. The bra is thus free-floating and provides improved fit, comfort, support and appearance to the wearer, particularly during dance movements. The leotard has an open and low rear neckline and may include one or more decorative strap treatments. The bra includes front and rear wall portions which are connected with the leotard. An adjustable fastener is arranged between the front and rear wall portions of the bra which are free of the leotard so that the wearer can adjust the bra for proper fit.

7 Claims, 1 Drawing Sheet

CLOTHING ARTICLE INCLUDING A BUILT-IN BRA

BACKGROUND OF THE INVENTION

The invention relates to female garments and especially female dancewear having a built-in semi-attached bra to provide improved fit, support, comfort and appearance to the wearer. The garments have a variety of open back and/or low rear neckline designs and a variety of strap configurations as desired by dancers.

Conventional dancewear such as leotards and other types of bodywear are formed of stretch synthetic material that provides little or no support for the breasts of a female wearer. Thus, the wearer often wears a separate bra. While a separate bra provides adequate support, it often results in bunching of the outer garment during dance movement because the bra is not adjustable for proper fit. In addition, the straps or other portions of a separate bra are visible through the outer garment, especially during dance movement. This diminishes the appearance of the dancer and also provides discomfort to the wearer.

Clothing garments having built-in bras are known in the patented prior art as evidenced by the US patents to Monroe U.S. Pat. No. 2,863,460 and Reichert et al U.S. Pat. No. 4,378,805. In the known prior art, the bra is connected with the outer garment continuously around the edge of the bra. While these prior devices operate satisfactorily, they are not particularly suited for dancers because they restrict the movement of the dancer and diminish the look of the dancer while performing. Moreover, they do not lend themselves to have open back or low rear neckline designs or different strap configurations.

The present invention was developed in order to overcome these and other drawbacks of the prior art by providing a dancewear article having a built-in floating bra which functions like a traditional bra but without the drawbacks of a separate bra. More particularly, the invention incorporates an open back or low rear neckline and a variety of strap configurations. This facilitates an open back which is a feature highly desired by dancers.

SUMMARY OF THE INVENTION

Accordingly, it is a primary object of the invention to provide a clothing article for females which includes an article of bodywear such as a leotard, top, dress, or unitard and a support structure such as a bra connected with the bodywear article. The bodywear article has a low rear neckline which defines an open back configuration which is preferred by many dancers. The support structure is connected with the bodywear article along an upper edge so that the structure supports the wearer's breasts in a free-floating fashion. More particularly, the bra has front and rear wall portions that are partially joined at the side with stitching and a fastener assembly. Preferably, only the upper edges of the front and rear wall portions of the bra are connected with the bodywear article. According to a preferred embodiment, the bra is connected with the bodywear article by stitching into the neckline and underarm seams of the bodywear article. The lower edge of the bra is not connected with the bodywear article.

Fasteners are connected between the front and rear walls of the bra to adjust the bra to fit the wearer. The fasteners and adjacent portions of the rear wall portions are not connected with the bodywear article so that bunching of the article and an improper fit of the bra on the user are prevented. Thus, the floating bra adjusts to the user to allow freedom of dance movement while maintaining a proper fit of the bra.

The bra includes support cups, typically made of molded foam material, which are stitched to the front wall portion.

BRIEF DESCRIPTION OF THE FIGURES

Other objects and advantages of the invention will become apparent from a study of the following specification when viewed in the light of the accompanying drawing, in which.

DETAILED DESCRIPTION

Figure 1:
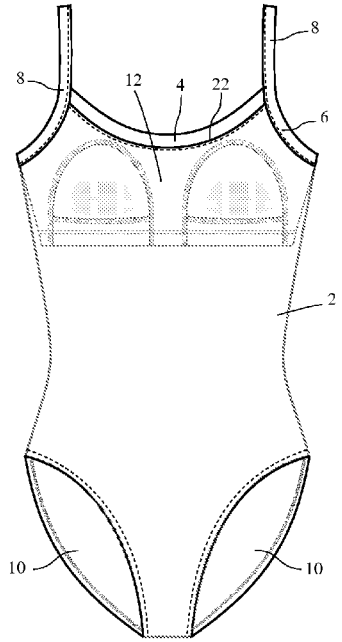
FIGS. 1 and 2 are front and rear plan views, respectively, of the clothing article having a built-in bra according to the invention.
Figure 2:
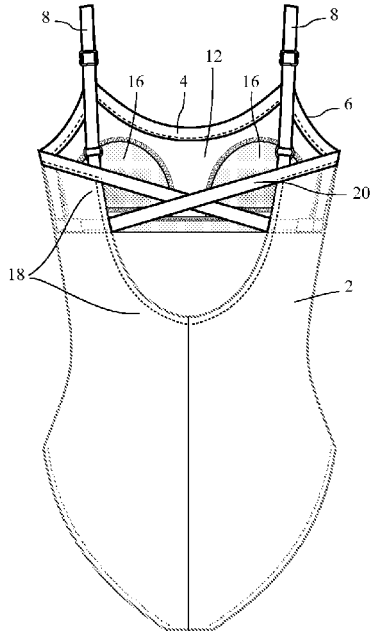

The preferred embodiment of the invention will first be described with reference to FIGS. 1 and 2. As shown therein, an article of bodywear such as a leotard 2 is provided. The leotard has a stitched neckline seam 4 and stitched underarm seams 6 as is known in the art. The leotard further includes vertical straps 8 which are arranged to pass over the shoulders of the wearer and openings 10 in the bottom portion for the legs of the wearer.

Figure 3:
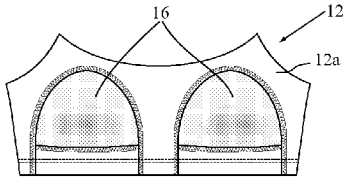
FIG. 3 is front plan view of the bra according to the invention.
Figure 4:
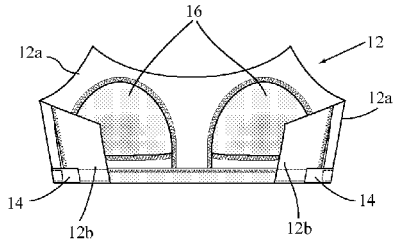
FIG. 4 is a rear plan view of the bra of FIG. 3.

A bra 12 is connected with the upper portion of the leotard. As shown more particularly in FIGS. 3 and 4, the bra includes a front wall portion 12*a* and rear wall portions 12*b*. The rear wall portions have one side edge 12*c* connected with opposite side edges of the front wall via adjustable fasteners 14 as will be developed in greater detail below. The other rear wall side edge 12*d* terminates in an open back area of the leotard as will be developed below.

The front wall portion 12*a* of the bra contains a pair of bra cups 16 which are preferably formed of molded foam material as is known in the art. The cups are encased in a knit fabric material which provides a limited amount of flex or give for sizing and comfort. The bra front and rear wall portions are formed of a stretch material of synthetic or natural fibers or a blend thereof to afford the wearer a full range of movement since dancers use muscular structure behind the breasts for movement. As the dancer moves, the breasts move with the dancer because the bra is fully adjustable and made of stretch material. The bra is supportive, but the breasts are still allowed to move in the direction of the muscle and not held stationary with the torso as is the case with separate bras. Bra cups of different sizes, widths and shapes may be provided to accommodate wearers of different sizes.

Referring once again to FIG. 2, the leotard is provided with a low rear neckline 18 defining an open back configuration which is desirable for many dancers. If desired, straps 20 extend from the underarm seam across the open back of the leotard and are connected with a seam of the neckline. Many other configurations are also possible.

An important feature of the invention is the manner in which the bra 12 is connected with the leotard. Specifically, the upper edges of the bra front and rear wall portions are connected with the leotard by stitching 22. In addition, the free edges of the bra rear wall portions are connected with the rear neckline, preferably by stitching 22 as well. The stitching used to connect the bra to the leotard could be a flat cover stitch, a binding or any type of joining construction along the neckline seam 4, the underarm seams 6, and a portion of the rear neckline 18. The remaining portion of the bra is not connected with the leotard in any fashion so that it floats relative to the leotard.

Figure 5:
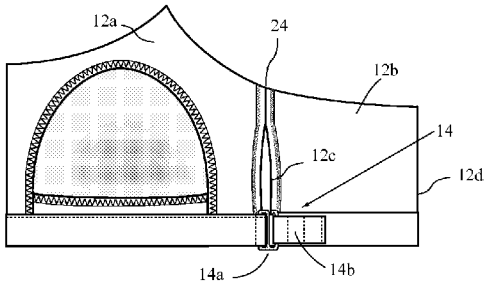
FIG. 5 is a partial side view of the bra of FIGS. 3 and 4 showing an adjustable fastener therefore.
Figure 6:
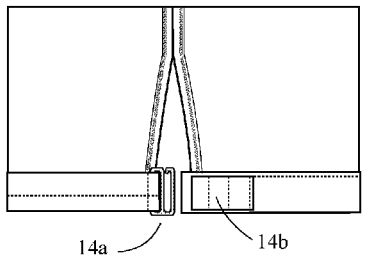
FIG. 6 is a detailed side view of the fastener of FIG. 5 in an unhooked condition.

Referring now to FIG. 5, the adjustable connection between the front 12*a* and rear 12*b* wall portions of the bra will be described. As noted above, the bra wall portions are formed of stretch material. The top portions of the adjacent edges are connected together by stitching to define a seam 24. However the seam does not extend completely along the edges of the front and rear portions. Rather, a fastener 14 is provided to adjustably connect the bottom portions of the adjacent edges of the front and rear wall portions. The fastener shown in the drawing includes a hook portion 14*a* connected with the bottom of one of the wall portion edges. In FIG. 5, the hook portion is connected with the bottom portion of the edge of the front wall portion 12*a*. A series of contiguous lateral loops 14*b* are provided at the bottom of the other wall portion which in FIG. 5 is the rear wall portion 12*b*. Thus, similar fasteners are provided on both sides of the bra generally beneath the underarm seams 6. FIG. 6 shows the fastener system of FIG. 5 in an unhooked condition. It will be appreciated by those of ordinary skill in the art that other types of fasteners such as VELCRO® type fasteners, snaps, buttons and the like can be used to connect the front and back walls.

With the fasteners 14 disconnected, the wearer inserts her legs through the openings 10 and pulls the leotard up over the hips. The wearer inserts the fastener hooks 14*a* into selected ones of the loops 14*b*. Next the wearer pulls the leotard with bra up over the chest, places the straps over the shoulders, and checks the fit of the bra. If adjustment is necessary, the fasteners can be disconnected and the hook portions inserted into different loops. Once the bra is adjusted, it is not necessary to unhook the fasteners between changes unless further adjustment is needed. Since the fasteners are separate from the garment, bunching, gathering and wrinkling of the garment is prevented. The fasteners thus afford a proper fit of both the garment and the bra.

The vertical straps 8 are provided on the leotard solely for design features, styling, and proper fit because the straps are adjustable in length. No additional strapping for the bra is required as is the case with separate bras which are not connected with the article.

Because the bra is only connected with the leotard at its upper edge and along the end edges of the rear wall portions adjacent the rear neckline 18, the appearance of the clothing article, both off the wearer such as when hanging on a display rack, and on the wearer such as during dance movement, is improved. When worn, the garment is unique when compared to garments of the prior art in that it offers a polished seamless look and shape, it provides support to the user, keeping the breasts in place while in motion, and provides a comfort level which enhances the esteem and confidence of the wearer.

Although the invention has been illustrated and described as a leotard with a built-in bra, other types of active wear or sports wear including tops, dresses and unitards may also be used as the outer garment and provided with a built-in floating bra connected only along its upper surface with the garment.

While the preferred forms and embodiments of the invention have been illustrated and described, it will be apparent from those of ordinary skill in the art that various changes and modification may be made without deviating from the inventive concepts set forth above.

What is claimed is:

1. A clothing article for females, comprising (a) an article of bodywear, at least a portion of which is to be worn over the torso area of a female, said article of bodywear having a front neckline and low rear neckline extending below said front neckline to define an open back configuration;

(b) a support continuously connected along an upper edge thereof with said bodywear article for supporting the wearer's breasts in a free-floating fashion, said support including a front wall portion and rear wall portions extending toward each other, said rear wall portions having free edges terminating at said rear neckline of said article in spaced relation to define an open back configuration concurrent with said open back configuration of said article, said support including a lower edge portion free of said article; and (c) an adjustment mechanism arranged in said support lower edge between said front and rear portions for adjusting said support.

2. A clothing article as defined in claim 1, wherein said support is stitched to said article along said front and rear necklines.

3. A clothing article as defined in claim 2, wherein said support comprises a bra and said adjustment mechanism comprises a hook connected with one of said bra front and rear wall portions and a plurality of laterally spaced loops connected with the other of said bra front and rear wall portions, whereby the wearer can select which loop is to receive said hook in order to laterally adjust said bra on at least one side of the clothing article.

4. A clothing article as defined in claim 3, wherein said bra front and rear wall portions are formed of stretch material.

5. A clothing article as defined in claim 3, wherein said bra includes support cups in said front wall portion for receiving and supporting the wearer's breasts.

6. A clothing article as defined in claim 1, wherein said bodywear article comprises a leotard.

7. A clothing article as defined in claim 1, wherein said adjustment mechanism is arranged in said lower edge portion of said support.

* * * * *